US008648580B2

(12) United States Patent
Wong

(10) Patent No.: US 8,648,580 B2
(45) Date of Patent: Feb. 11, 2014

(54) REGULATOR WITH HIGH PSRR

(75) Inventor: KianTiong Wong, Johor (MY)

(73) Assignee: Mediatek Singapore Pte. Ltd., Singapore (SG)

( * ) Notice: Subject to any disclaimer, the term of this patent is extended or adjusted under 35 U.S.C. 154(b) by 289 days.

(21) Appl. No.: 13/196,633

(22) Filed: Aug. 2, 2011

(65) Prior Publication Data

US 2012/0146595 A1 Jun. 14, 2012

Related U.S. Application Data

(60) Provisional application No. 61/420,909, filed on Dec. 8, 2010.

(51) Int. Cl.
*G05F 1/00* (2006.01)

(52) U.S. Cl.
USPC ..... 323/265; 323/273; 323/274; 323/275; 323/311; 323/312; 323/313; 323/314; 323/315; 323/316; 323/317

(58) Field of Classification Search
USPC ..... 323/273, 274, 275, 311–317; 327/538–541
See application file for complete search history.

(56) References Cited

U.S. PATENT DOCUMENTS

| | | | | |
|---|---|---|---|---|
| 5,570,004 | A * | 10/1996 | Shibata | 323/303 |
| 5,739,681 | A * | 4/1998 | Allman | 323/314 |
| 6,359,427 | B1 * | 3/2002 | Edwards et al. | 323/316 |
| 7,719,345 | B2 | 5/2010 | Cho et al. | |
| 8,456,235 | B2 * | 6/2013 | Tachibana et al. | 330/253 |
| 2005/0007189 | A1 * | 1/2005 | Bo et al. | 327/541 |
| 2009/0195302 | A1 | 8/2009 | Lin et al. | |
| 2009/0315531 | A1 | 12/2009 | Liao et al. | |
| 2010/0156362 | A1 | 6/2010 | Xie | |

* cited by examiner

*Primary Examiner* — Nguyen Tran
*Assistant Examiner* — Afework Demisse
(74) *Attorney, Agent, or Firm* — McClure, Qualey & Rodack, LLP

(57) ABSTRACT

A regulator for providing a low dropout voltage at an output node of the regulator is provided. An amplifier has a non-inverting input terminal for receiving an input voltage, an inverting input terminal and an output terminal. A first resistor is coupled between a ground and the inverting input terminal of the amplifier. A second resistor is coupled to the inverting input terminal of the amplifier. A first transistor is coupled between a voltage source and the second resistor. A current source coupled between the voltage source and a gate of the first transistor provides a bias current. A second transistor coupled between the first transistor and a current mirror has a gate coupled to the output terminal of the amplifier. The first and second transistors are different type MOS transistors. The replica unit generates the low dropout voltage according to a voltage of the output terminal of the amplifier.

19 Claims, 3 Drawing Sheets

REGULATOR WITH HIGH PSRR

CROSS REFERENCE TO RELATED APPLICATIONS

This application claims priority of U.S. Provisional Application No. 61/420,909, filed on Dec. 8, 2010, the entirety of which is incorporated by reference herein.

BACKGROUND OF THE INVENTION

1. Field of the Invention

The present invention is related to a regulator, and more particularly to a regulator with a high power supply rejection ratio (PSRR).

2. Description of the Related Art

Voltage regulators are used in a variety of systems to provide a regulated voltage to other circuits in the system. Generally, it is desirable to provide a stable regulated voltage in the face of a wide variety of loads, operating frequencies, etc. In other words, a voltage regulator is designed to provide and maintain a constant voltage in electrical applications, wherein a low dropout (LDO) voltage regulator is a DC linear voltage regulator which has a very small input-output differential voltage and relatively low output noise.

A measure of the effectiveness of a voltage regulator is its power supply rejection ratio (PSRR), which measures the amount of noise present on the power supply to the voltage regulator which is transmitted to an output voltage of the voltage regulator. A high PSRR is indicative of a low amount of noise transmission, and a low PSRR is indicative of a high amount of noise transmission. A high PSRR, particularly across a wide range of operating frequencies of devices being supplied by a voltage regulator, is difficult to achieve.

For example, assume that a crystal oscillator (XO) and a digitally controlled oscillator (DCO) of an all digital phase locked loop (ADPLL) are supplied by one LDO regulator. If the clock signal generated by the XO kicks back to its supply voltage, the clock signal may kick back again to the LDO regulator's supply voltage. If a high frequency PSRR is not high enough at the frequency offset or frequency range, the kick back noise may affect the supply voltage of the DCO. To prevent the de-sensing or interference problem, high PSRR performance is very important.

BRIEF SUMMARY OF THE INVENTION

An embodiment of a regulator for providing a low dropout voltage at an output node of the regulator is provided. The regulator comprises a core circuit and at least one replica unit. The core circuit comprises: an amplifier having a non-inverting input terminal for receiving an input voltage, an inverting input terminal, and an output terminal; a first resistor coupled between a ground and the inverting input terminal of the amplifier; a second resistor having a first terminal coupled to the inverting input terminal of the amplifier and a second terminal; and a basic unit. The basic unit comprises: a first transistor coupled between a first voltage source and the second terminal of the second resistor, having a gate; a first current source coupled between the first voltage source and the gate of the first transistor, providing a bias current; a second transistor, having a first terminal coupled to the second terminal of the second resistor, a gate coupled to the output terminal of the amplifier and a second terminal, wherein the first and second transistors are different type MOS transistors; and a first current mirror, coupled to a second voltage source, the first current source and the second terminal of the second transistor. The replica unit generates the low dropout voltage according to a voltage of the output terminal of the amplifier. A voltage level of the low dropout voltage is determined according to the input voltage and a ratio of the second resistor to the first resistor.

Furthermore, an embodiment of a regulator for providing a low dropout voltage at an output node of the regulator is provided. The regulator comprises an amplifying unit, a basic unit and at least one replica unit. Each of the basic unit and the replica unit comprises: a first NMOS transistor, having a first terminal coupled to a supply voltage, a gate and a second terminal; a current source coupled between the supply voltage and the gate of the first NMOS transistor, providing a bias current; a PMOS transistor, having a first terminal coupled to the second terminal of the first NMOS transistor, a gate and a second terminal; and a current mirror coupled to a ground, the current source and the second terminal of the PMOS transistor. The amplifying unit comprises an output terminal coupled to the gate of the PMOS transistor and a feedback terminal, wherein the amplifying unit amplifies an input voltage at the feedback terminal. The second terminal of the first NMOS transistor of the basic unit is coupled to the feedback terminal of the amplifying unit and the second terminal of the first NMOS transistor of the replica unit is coupled to the output node of the regulator, such that the amplifying unit and the basic unit form a feedback loop and the replica unit generates the low dropout voltage according to a voltage of the output terminal of the amplifying unit in the feedback loop.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
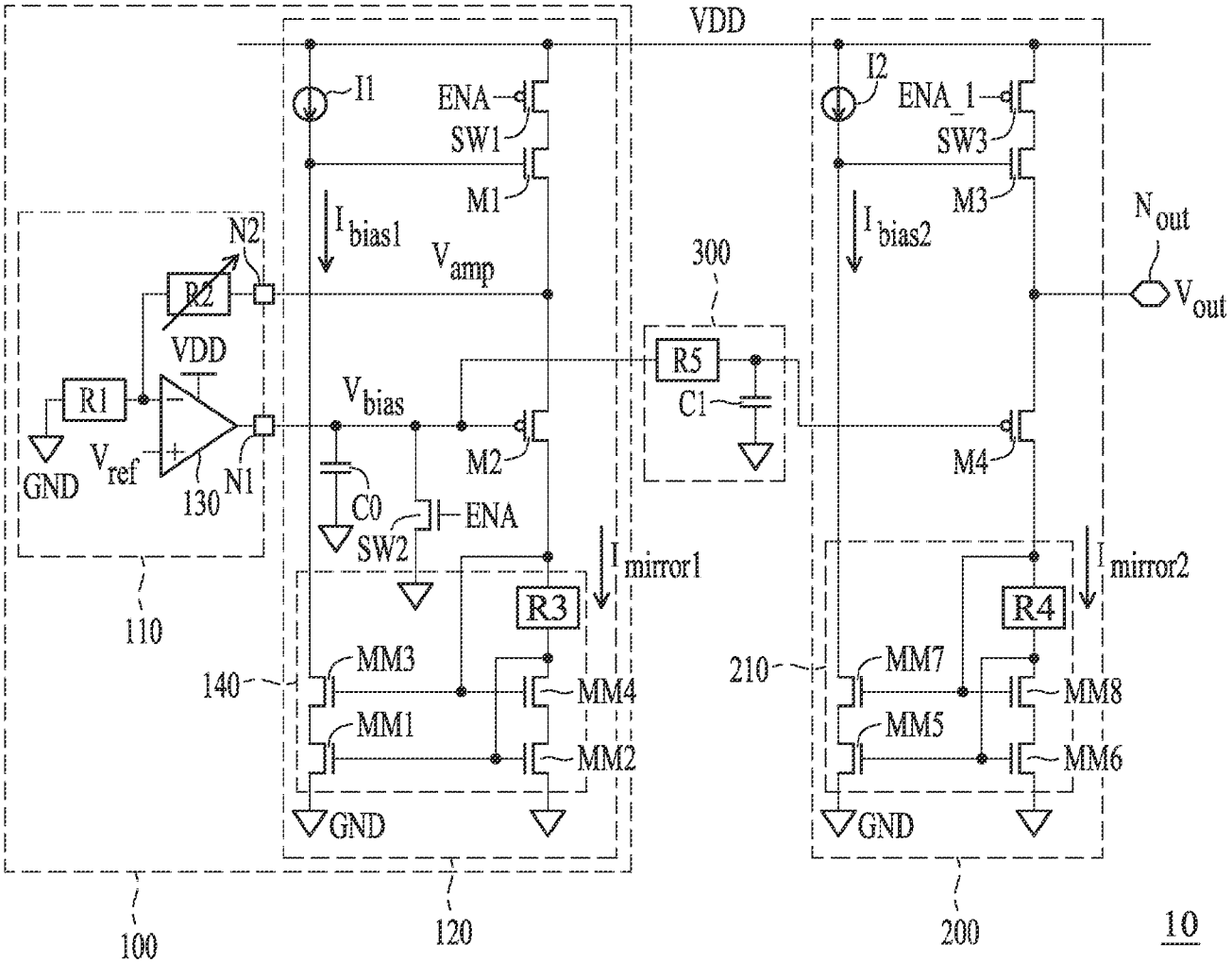
FIG. 1 shows a regulator according to an embodiment of the invention.

FIG. 1 shows a regulator 10 according to an embodiment of the invention. The regulator 10 is a source follower typed replica capless low dropout (LDO) voltage regulator, which provides an LDO voltage $V_{out}$ at an output node $N_{out}$. The regulator 10 comprises a core circuit 100 and a replica unit 200. The core circuit 100 comprises an amplifying unit 110 and a basic unit 120. The amplifying unit 110 comprises an amplifier 130 and two resistors R1 and R2. The amplifier 130 has a non-inverting input terminal (+) receiving an input voltage $V_{ref}$, an inverting input terminal (−) coupled to the resistors R1 and R2, and an output terminal coupled to an output terminal N1 of the amplifying unit 110. The resistor R1 is coupled between a ground GND and the inverting input terminal of the amplifier 130, and the resistor R2 is coupled between the inverting input terminal of the amplifier 130 and a feedback terminal N2 of the amplifying unit 110. The basic unit 120 comprises a current source I1, two transistors M1 and M2 and a current mirror 140. The current source I1 is coupled between a supply voltage VDD and a gate of the transistor M1, which provides a fixed bias current $I_{bias1}$ to the current mirror 140. The transistor M1 is coupled between the supply voltage VDD and the feedback terminal N2 of the amplifying unit 110, and the transistor M2 is coupled between the feedback terminal N2 of the amplifying unit 110 and the current mirror 140. It is to be noted that the transistors M1 and M2 are different type MOS transistors. In the embodiment, the transistor M1 is an NMOS transistor and the transistor M2 is a PMOS transistor. In the embodiment, the transistor M1 is a native device. In other embodiments, the transistor M1 is an N-type transistor for I/O circuit or core circuit. The current mirror 140 comprises four mirror transistors MM1-MM4 and a resistor R3. The mirror transistors MM1 and MM3 are cascaded between the ground GND and the current source I1, and the mirror transistors MM2 and MM4 and the resistor R3 are cascaded between the ground GND and the transistor M2. A gate of the mirror transistor MM2 is coupled to a gate of the mirror transistor MM1 and a first terminal of the resistor R3, and a gate of the mirror transistor MM4 is coupled to a gate of the mirror transistor MM3 and a second terminal of the resistor R3. In the embodiment, the current mirror 140 is an example and does not limit the invention.

In FIG. 1, the amplifying unit 110 and the basic unit 120 form a feedback loop. Firstly, assuming a current $I_{mirror1}$ initially flowing through the mirror transistors MM2 and MM4 is zero, then, the gate of the transistor M1 is pulled to high due to the fact that the bias current $I_{bias1}$. Thus, the current $I_{mirror1}$ is going to go from the supply voltage VDD to the ground GND through the transistors M1 and M2, the resistor R3 and the mirror transistors MM2 and MM4, and then the gate of the transistor M1 is pulled back due to a closed loop being formed. The closed loop stabilizes when the current $I_{mirror1}$ is equal to the bias current $I_{bias1}$. Therefore, according to a ratio of the resistor R2 to the resistor R1 and the input voltage $V_{ref}$, the amplifier 130 obtains a bias voltage $V_{bias}$ at the output terminal N1 and an amplified voltage $V_{amp}$ at the feedback terminal N2 in the feedback loop, i.e.

$$V_{amp} = \frac{R1 + R2}{R1} V_{ref}$$

and $V_{bias}=V_{amp}-|V_{gsM2}|$, where $V_{gsM2}$ represents a gate-source voltage of the transistor M2. In the embodiment, the resistor R2 is varied to adjust the amplified voltage $V_{amp}$. Furthermore, the basic unit 120 further comprises a switch SW1 coupled between the supply voltage VDD and the transistor M1 and a switch SW2 coupled between the ground GND and the output terminal of the amplifier 130, wherein the switches SW1 and SW2 are controlled, together, by a signal ENA. In the embodiment, the switch SW1 is a PMOS transistor and the switch SW2 is an NMOS transistor. Therefore, the switches SW1 and SW2 are not turned on at the same time. When the regulator 10 is powered down, the signal ENA controls the switch SW1 to turn off and the switch SW2 to turn on, thus, no current $I_{mirror1}$ is generated. On the contrary, the switch SW1 is turned on and the switch SW2 is turned off when the regulator 10 is powered on. In the regulator 10, the switch SW1 further provides electrostatic discharge (ESD) protection, and the switch SW2 and a capacitor C0 further provides a start-up function to avoid overshoot. Specifically, the switch SW2 is used to initialize the bias voltage $V_{bias}$ rising up from zero voltage when the regulator 10 starts up, to avoid overshoot in the LDO voltage $V_{out}$.

The replica unit 200 comprises a current source I2, a switch SW3, two transistors M3 and M4 and a current mirror 210. The current source I2 is coupled between the supply voltage VDD and a gate of the transistor M3, which provides a bias current $I_{bias2}$ to the current mirror 140, wherein the bias current $I_{bias2}$ matches the bias current $I_{bias1}$ of the basic unit 120. The switch SW3 is coupled between the supply voltage VDD and the transistor M3, and the switch SW3 is also controlled by a signal ENA_1. In the replica unit 200, the signal ENA is obtained according to the signal ENA_1, so that the switch SW1 is turned on when the switch SW3 is turned on. The transistor M3 is coupled between the supply voltage VDD and the output node $N_{out}$, and the transistor M4 is coupled between the output node $N_{out}$ and the current mirror 210. Similarly, the transistors M3 and M4 are different type MOS transistors. In the embodiment, the transistor M3 is an NMOS transistor and the transistor M4 is a PMOS transistor. In the embodiment, the transistor M3 is a native device. In other embodiments, the transistor M3 is an N-type transistor for I/O circuit or core circuit. It is to be noted that size of the transistor M4 matches that of the transistor M2. The current mirror 210 comprises four mirror transistors MM5-MM8 and a resistor R4, wherein a current $I_{mirror2}$ flowing through the transistor MM6 and MM8 is equal to the bias current $I_{bias2}$. In the embodiment, the current mirror 210 is an example and does not limit the invention. In the regulator 10, when the basic unit 120 and the replica unit 200 are at stable states, the gate-source voltages of the transistors M2 and M4 are the same, $V_{gsM2}=V_{gsM4}$, due to the fact that the sizes and currents (i.e. currents $I_{mirror1}$ and $I_{mirror2}$) of the transistors M2 and M4 are the same and the gates of the transistors M2 and M4 are connected, together, to the output terminal of the amplifier 130. Thus, the LDO voltage $V_{out}$ and the amplified voltage $V_{amp}$ are identical, as shown in the following equation:

$$V_{out} = V_{bias} + |V_{gsM4}| = (V_{amp} - |V_{gsM2}|) + |V_{gsM4}| = V_{amp} = \frac{R1 + R2}{R1} V_{ref}.$$

Furthermore, the regulator 10 further comprises a low pass filter (LPF) 300 between the gates of the transistors M2 and M4, wherein the LPF 300 is used to filter out noise from the bias voltage $V_{bias}$. In the embodiment, the LPF 300 comprises a resistor R5 coupled between the gates of the transistors M2 and M4 and a capacitor C1 between the gate of the transistor M4 and the ground GND. It is to be noted that the gate voltages of the transistors M2 and M4 and the bias voltage $V_{bias}$ are assumed to be equal. In the embodiment, the LPF 300 is an example and does not limit the invention. Furthermore, the sizes of the devices within the replica unit 200 should be equal or proportional to the sizes of the devices within the basic unit 120, such that the current $I_{mirror2}$ matches the current $I_{mirror1}$.

If a load current of the regulator 10 increases rapidly, such as when, a sudden current is drained from the output node $N_{out}$ to a loading, the LDO voltage $V_{out}$ will drop, thereby, the transistor M4 is gradually turned off due to the fact that the gate of the transistor M4 is forced by the output of the amplifier 130. Next, the current $I_{mirror2}$ flowing through the transistor M4 and the mirror transistors MM6 and MM8 is decreased gradually, i.e. the current $I_{mirror2}$ is smaller than the bias current $I_{bias2}$. Next, the bias current $I_{bias2}$ pulls the gate of the transistor M3 to high, to cause a current to the output node $N_{out}$ from the supply voltage VDD, thus, pulling the LDO voltage $V_{out}$ back. On the contrary, if the load current of the regulator 10 decreases rapidly, excess current from the supply voltage VDD will flow to the mirror transistors MM6 and MM8, making the current $I_{mirror2}$ larger than the bias current $I_{bias2}$, thus, pulling low the gate of the transistor M3. Therefore, the current from the supply voltage VDD is decreased and the LDO voltage $V_{out}$ is pulled back.

Since the transistor M3 is an NMOS, the power supply rejection ratio (PSRR) of the regulator 10 is close to 1/(gm× ro) at a high frequency, where gm and ro are the transconductance and the output resistance of the transistor M3, respectively. Furthermore, PSRR at a low frequency can be enhanced through the PSRR cancellation mechanism in the regulator 10. For example, noise from the supply voltage VDD can be divided into five paths P1, P2, P3, P4 and P5. The path P1 is from the supply voltage VDD to the output node $N_{out}$ through the switch SW3 and the transistor M3. The path P2 is from the supply voltage VDD to the output node $N_{out}$ through the current source I2 and the transistor M3. The path P3 is from the supply voltage VDD to the output node $N_{out}$ through the switch SW1, the transistor M1, the resistor R2, the amplifier 130, LPF 300 and the transistor M4. The path P4 is from the supply voltage VDD to the output node $N_{out}$ through the current source I1, the transistor M1, the resistor R2, the amplifier 130, LPF 300 and the transistor M4. The path P5 is from the supply voltage VDD to the output node $N_{out}$ through the amplifier 130, LPF 300 and the transistor M4. Due to the fact that the amplifier 130 is operated in a negative feedback loop, the noise through the paths P4 and P3 is reversed in the output node $N_{out}$, thus, the noise through the paths P1 and P2 are cancelled out. Therefore, the PSRR at a low frequency is enhanced. In addition, reversed isolation from the LDO voltage $V_{out}$ to the input voltage $V_{ref}$ is better than conventional replica LDO regulators, so the non-inverting input terminal of the amplifier 130 can be directly connected to a very sensitive reference point (e.g. a bandgap voltage VBG).

Figure 2:
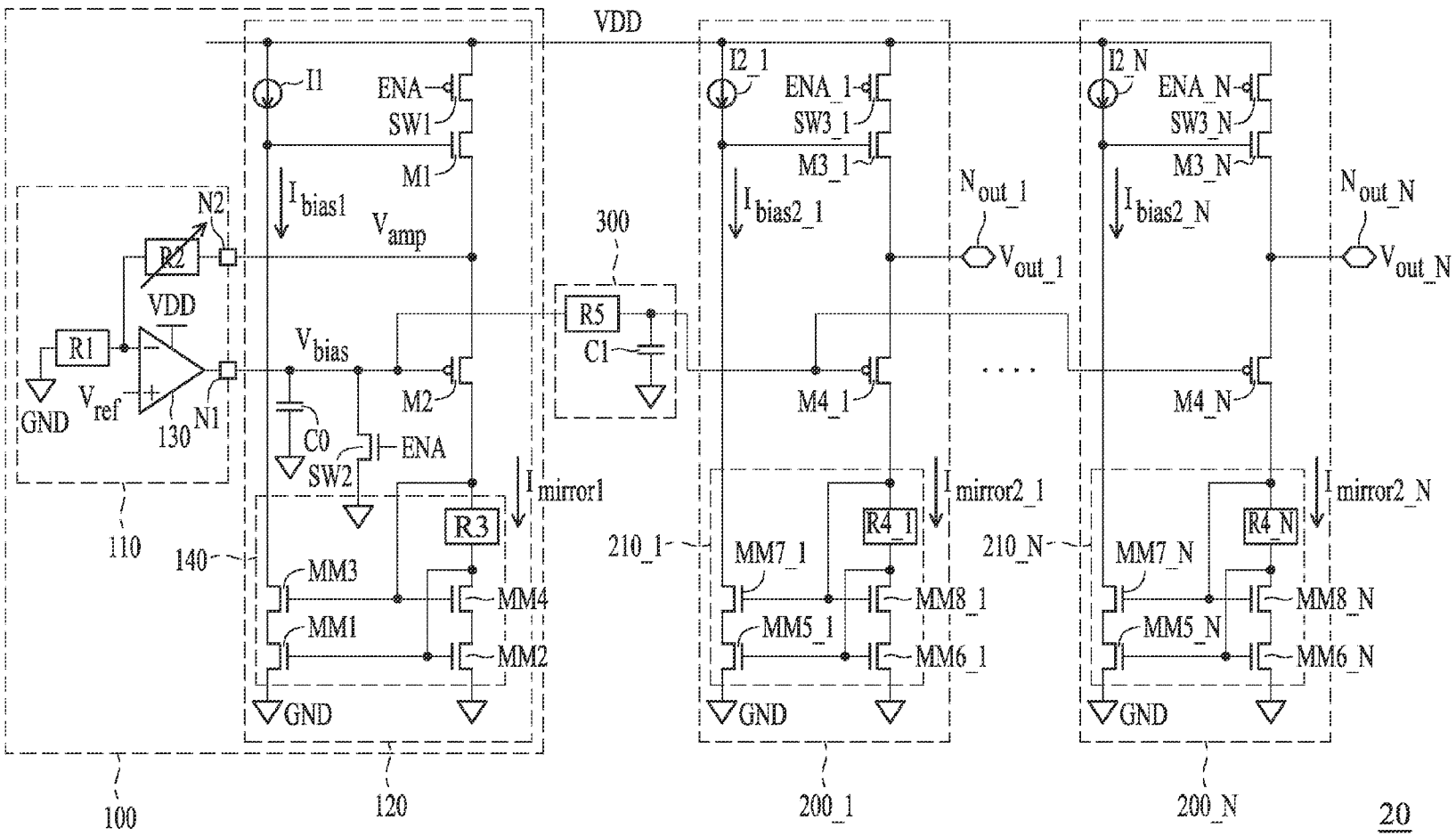
FIG. 2 shows a regulator according to another embodiment of the invention.

FIG. 2 shows a regulator 20 according to another embodiment of the invention. The regulator 20 comprises a core circuit 100 and a plurality of replica units 200_1 to 200_N. In the regulator 20, the bias voltage $V_{bias}$ is duplicated to bias the replica units 200_1 to 200_N. The replica units 200_1 to 200_N have the same circuits, each providing an individual LDO voltage at an individual output node. For example, the replica unit 200_1 provides an LDO voltage $V_{out_1}$ at an output node $N_{out_1}$, and the replica unit 200_N provides an LDO voltage $V_{out_N}$ at an output node $N_{out_N}$. It is to be noted that each of the bias currents $I_{bias2_1}$ to $I_{bias2_N}$ provided by the current sources I2_1 to I2_N matches the bias current $I_{bias1}$ provided by the current source I1, and each of the transistors M4_1 to M4_N of the replica units 200_1 to 200_N matches that of the transistor M2. Therefore, when the basic unit 120 and the replica units 200_1 to 200_N are at stable states, the gate-source voltages of the transistor M2 and the transistors M4_1 to M4_N are the same due to the fact that the sizes and currents of the transistors M2 and M4_1 to M4_N are the same and the gates of the transistor M2 and the transistors M4_1 to M4_N are connected, together, to the output terminal of the amplifier 130. In one embodiment, by proportionating the sizes of the transistors M2 and M4_1 to M4_N and the currents of the transistors M2 and M4_1 to M4_N (i.e. the current sources I1 and I2_1 to I2_N), the gate-source voltages of the transistor M2 and the transistors M4_1 to M4_N are the same. Thus, the LDO voltages $V_{out_1}$ to $V_{out_N}$ are identical to the amplified voltage $V_{amp}$. Therefore, the regulator 20 can provide a plurality of LDO voltages with the same voltage level to various circuits having different current loadings. Compared with conventional replica LDO regulators, only global matching is needed to be considered for the transistor M2 and the transistors M4_1 to M4_N and the current source I1 and the current sources I2_1 to I2_N in the regulator 20 for design and layout. For the current mirror 210 of each of the replica units 200_1 to 200_N, local matching needs to be considered, thus, design and layout complexity is decreased. Furthermore, the switches SW3_1 to SW3_N of the replica units 200_1 to 200_N are controlled by the signals ENA_1 to ENA_N, respectively. In the regulator 20, the signal ENA is obtained according to the signals ENA_1 to ENA_N, so that the switch SW1 is turned on when any one of the switches SW3_1 to SW3_N is turned on. For example, the signal ENA is a result of OR operation of the signals ENA_1 to ENA_N. For the replica units 200_1 to 200_N, the sizes of the switches SW3_1 to SW3_N can be the same or different, which depend on the capability for IR drop. Furthermore, the sizes of the power transistors M3_1 to M3_N can be the same or different, which depend on supplied currents for the replica units 200_1 to 200_N. Moreover, the sizes of the devices within the replica units 200_1 to 200_N should be equal or proportional to the sizes of the devices within the basic unit 120, such that each of the currents $I_{mirror2_1}$ to $I_{mirror21_N}$ matches the current $I_{mirror1}$.

Figure 3:
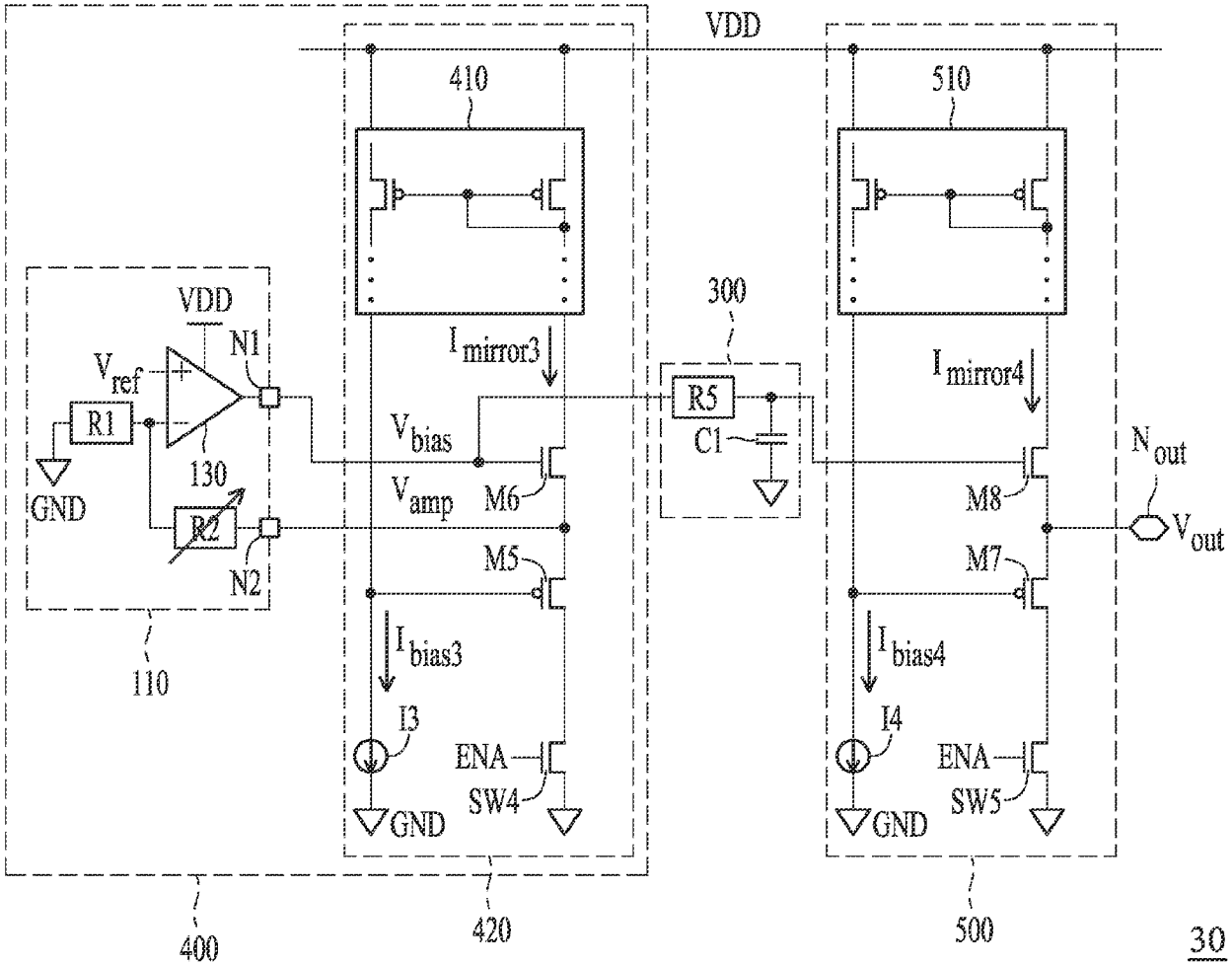
FIG. 3 shows a regulator according to another embodiment of the invention.

FIG. 3 shows a regulator 30 according to another embodiment of the invention. The regulator 30 comprises a core circuit 400, a LPF 300 and a replica unit 500. The core circuit 400 comprises an amplifying unit 110 and a basic unit 420. The basic unit 420 comprises a current source I3, the transistors M5 and M6, a switch SW4 and a current mirror 410, wherein the current source I3 drains a bias current $I_{bias3}$ from the current mirror 410 and the current mirror 410 provides a current $I_{mirror3}$ mirror to the bias current $I_{bias3}$. The replica unit 500 comprises a current source I4, the transistors M7 and M8, a switch SW5 and a current mirror 510, wherein the current source I4 drains a bias current $I_{bias4}$ from the current mirror 510 and the current mirror 410 provides a current $I_{mirror4}$ mirror to the bias current $I_{bias4}$. In the regulator 30, the transistors M5 and M7 are PMOS transistors and the transistor M6 and M8 are NMOS transistors, wherein the transistors M5 and M7 are native devices. When the basic unit 420 and the replica unit 500 are at stable states, the gate-source voltages of the transistors M6 and M8 are the same due to the fact that the sizes and currents (i.e. currents $I_{mirror3}$ and $I_{mirror4}$) of the transistors M6 and M8 are the same and the gates of the transistors M6 and M8 are connected, together, to the output terminal of the amplifier 130. Thus, the LDO voltage $V_{out}$ and the amplified voltage $V_{amp}$ are identical. Similarly, the regulator 30 comprises a low pass filter 300 between the gates of the transistors M6 and M8. In response to the variation of the LDO voltage $V_{out}$ caused by the variation in loadings or others disturbances, the gate of the transistor M7 is controlled according to a relationship between the bias current $I_{bias4}$ and the $I_{mirror4}$, so as to regulate the LDO voltage $V_{out}$ back. In the embodiment, the switches SW4 and SW5 are controlled, together, by a signal ENA, wherein the switches SW4 and SW5 are NMOS transistors. Furthermore, the sizes of the devices within the basic unit 420 should be equal or proportional to the sizes of the devices within the replica unit 500, such that the current $I_{mirror3}$ matches the current $I_{mirror4}$.

According to the embodiments, the source follower typed replica capless LDO regulators can provide a high PSRR from several MHz to hundred MHz. Furthermore, through the cancellation mechanism, the regulators further improve low frequency PSRR. Therefore, the source follower typed replica capless LDO regulators can provide replicated output voltages to relative circuits; especially level shifters, digital circuits, analog circuits and RF circuits, etc.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A regulator for providing a low dropout voltage at an output node of the regulator, comprising:

a core circuit, comprising:

an amplifier having a non-inverting input terminal for receiving an input voltage, an inverting input terminal, and an output terminal;

a first resistor coupled between a ground and the inverting input terminal of the amplifier;

a second resistor having a first terminal coupled to the inverting input terminal of the amplifier and a second terminal; and a basic unit, comprising:

a first transistor coupled between a first voltage source and the second terminal of the second resistor, having a gate;

a first current source coupled between the first voltage source and the gate of the first transistor, providing a bias current;

a second transistor, having a first terminal coupled to the second terminal of the second resistor, a gate coupled to the output terminal of the amplifier and a second terminal, wherein the first and second transistors are different type MOS transistors; and a first current mirror, coupled to a second voltage source, the first current source and the second terminal of the second transistor; and at least one replica unit, generating the low dropout voltage according to a voltage of the output terminal of the amplifier, wherein a voltage level of the low dropout voltage is determined according to the input voltage and a ratio of the second resistor to the first resistor.

2. The regulator as claimed in claim 1, wherein the first transistor is an NMOS transistor and the second transistor is a PMOS transistor, and wherein the first and second voltage sources are arranged to provide a supply voltage and a signal ground, respectively.

3. The regulator as claimed in claim 1, wherein the first transistor is a PMOS transistor and the second transistor is an NMOS transistor, and wherein the first and second voltage sources are arranged to provide a signal ground and a supply voltage, respectively.

4. The regulator as claimed in claim 1, wherein the replica unit comprises:

a third transistor coupled between the first voltage source and the output node, having a gate;

a second current source coupled between the first voltage source and the gate of the third transistor, providing a current that matches the bias current;

a fourth transistor, having a first terminal coupled to the output node, a gate coupled to the output terminal of the amplifier and a second terminal, wherein the third and fourth transistors are different type MOS transistors and the size of the fourth transistor matches that of the second transistor; and a second current mirror, coupled to the second voltage source, the second current source and the second terminal of the fourth transistor, wherein the first and third transistors are native devices.

5. The regulator as claimed in claim 1, wherein the first current mirror comprises:

a first mirror transistor coupled between the second voltage source and the first current source; and a second mirror transistor coupled between the second voltage source and the second transistor, having a gate coupled to a gate of the first mirror transistor and the second terminal of the second transistor.

6. The regulator as claimed in claim 1, wherein the core circuit further comprises:

a first switch coupled between the first power source and first transistor; and a second switch coupled between the second power source and the gate of the second transistor, wherein the first switch is turned off and the second switch is turned on when the regulator is powered down, and the first switch is turned on and the second switch is turned off when the regulator is powered on.

7. The regulator as claimed in claim 1, wherein the first transistor is a native device.

8. A regulator for providing a low dropout voltage at an output node of the regulator, comprising:

a basic unit and at least one replica unit, each comprising:

a first NMOS transistor, having a first terminal coupled to a supply voltage, a gate and a second terminal;

a current source coupled between the supply voltage and the gate of the first NMOS transistor, providing a bias current;

a PMOS transistor, having a first terminal coupled to the second terminal of the first NMOS transistor, a gate and a second terminal; and a current mirror coupled to a ground, the current source and the second terminal of the PMOS transistor; and an amplifying unit comprising an output terminal coupled to the gate of the PMOS transistor and a feedback terminal, amplifying an input voltage at the feedback terminal, wherein the second terminal of the first NMOS transistor of the basic unit is coupled to the feedback terminal of the amplifying unit and the second terminal of the first NMOS transistor of the replica unit is coupled to the output node of the regulator, such that the amplifying unit and the basic unit form a feedback loop and the replica unit generates the low dropout voltage according to a voltage of the output terminal of the amplifying unit in the feedback loop.

9. The regulator as claimed in claim 4, wherein the first and third transistors are NMOS transistors and the second and fourth transistors are PMOS transistors, and wherein the first and second voltage sources are arranged to provide a supply voltage and a signal ground, respectively.

10. The regulator as claimed in claim 4, wherein the first and third transistors are PMOS transistors and the second and fourth transistors are NMOS transistors, and wherein the first and second voltage sources are arranged to provide a signal ground and a supply voltage, respectively.

11. The regulator as claimed in claim 4, further comprising:

a filter coupled between the gates of the second and fourth transistors, filtering noise from the voltage of the output terminal of the amplifier.

12. The regulator as claimed in claim 8, further comprising:

a filter coupled between the gates of the PMOS transistors of the basic unit and the replica unit, filtering noise from the voltage of the output terminal of the amplifying unit.

13. The regulator as claimed in claim 8, wherein the basic unit further comprises:

a first switch coupled between the supply voltage and first NMOS transistor; and a second switch coupled between the ground and the gate of the PMOS transistor, and the replica unit further comprises:

a third switch coupled between the supply voltage and the first NMOS transistor, wherein the first and third switches are turned off and the second switch is turned on when the regulator is powered down, and the first switch is turned on and the second switch is turned off when the third switch is turned on.

14. The regulator as claimed in claim 8, wherein the current mirror of each of the basic unit and the replica unit comprises:

a second NMOS transistor coupled between the ground and the current source; and a third NMOS transistor coupled between the ground and the PMOS transistor, having a gate coupled to a gate of the second NMOS transistor and the second terminal of the PMOS transistor.

15. The regulator as claimed in claim 8, wherein the first NMOS transistors of the basic unit and the replica unit are native devices.

16. The regulator as claimed in claim 8, wherein the amplifying unit further comprises:

an amplifier having a non-inverting input terminal for receiving the input voltage, an inverting input terminal, and an output terminal coupled to the output terminal of the amplifying unit;

a first resistor coupled between the ground and the inverting input terminal of the amplifier; and a second resistor coupled between the inverting input terminal of the amplifier and the feedback terminal of the amplifying unit.

17. The regulator as claimed in claim 16, wherein a voltage level of the low dropout voltage is determined according to the input voltage and a ratio of the second resistor to the first resistor.

18. The regulator of claim 1, wherein each of the at least one replica units comprises a second current mirror circuit, a second current source, and third and fourth transistors wherein a gate of the fourth transistor is coupled to the output terminal and the second current mirror, the second current source, and the third and forth transistors are arranged in a configuration that generally parallels a configuration of the first current mirror, the first current source, and the first and second transistors.

19. The regulator as claimed in claim 4, wherein the core circuit further comprises:

a first switch coupled between the first power source and first transistor; and a second switch coupled between the second power source and the gate of the second transistor, and the replica unit further comprises:

a third switch coupled between the first power source and the third transistor, wherein the first and third switches are turned off and the second switch is turned on when the regulator is powered down, and the first switch is turned on and the second switch is turned off when the third switch is turned on.

* * * * *